US006991274B2

(12) United States Patent
Brooks

(10) Patent No.: US 6,991,274 B2
(45) Date of Patent: Jan. 31, 2006

(54) CARGO CAGE AND SPREADER ATTACHMENT AND METHOD OF USE

(75) Inventor: Leonard W. Brooks, Englewood, CA (US)

(73) Assignee: Metropolitan Stevedore Company, Wilmington, CA (US)

( * ) Notice: Subject to any disclaimer, the term of this patent is extended or adjusted under 35 U.S.C. 154(b) by 22 days.

(21) Appl. No.: 10/156,519

(22) Filed: May 28, 2002

(65) Prior Publication Data

US 2003/0222468 A1 Dec. 4, 2003

(51) Int. Cl.
*B66C 1/66* (2006.01)

(52) U.S. Cl. ..... 294/81.51; 294/81.56; 294/81.61; 220/1.5

(58) Field of Classification Search ..... 294/81.5, 294/81.56, 74, 81.1, 81.2, 81.51, 81.61; 410/68, 410/89, 90, 91, 77, 80; 220/1.5; 414/626
See application file for complete search history.

(56) References Cited

U.S. PATENT DOCUMENTS

| | | | | | |
|---|---|---|---|---|---|
| 1,762,271 | A | * | 6/1930 | Hutchings | 294/81.55 |
| 1,846,038 | A | * | 2/1932 | Owens | 294/81.5 |
| 1,976,014 | A | * | 10/1934 | Forsythe | 294/81.5 |
| 2,904,370 | A | * | 9/1959 | Meinholtz et al. | 294/81.51 |
| 3,021,166 | A | * | 2/1962 | Hubert et al. | 294/81.5 |
| 3,106,421 | A | * | 10/1963 | Wyrough | 294/81.51 |
| 3,148,909 | A | * | 9/1964 | Tantlinger | 294/81.5 |
| 3,164,406 | A | * | 1/1965 | Barry | 294/81.51 |
| 3,262,729 | A | * | 7/1966 | Willison et al. | 294/81.51 |
| 3,399,921 | A | * | 9/1968 | Trost et al. | 410/69 |
| 3,528,569 | A | * | 9/1970 | Barry | 294/68.3 |
| 3,552,794 | A | | 1/1971 | Wright | |
| 3,614,150 | A | * | 10/1971 | Pasic | 294/81.56 |
| 3,782,772 | A | * | 1/1974 | Cranston et al. | 294/81.56 |
| 3,899,205 | A | * | 8/1975 | Lanigan et al. | 294/81.51 |
| 4,035,010 | A | * | 7/1977 | Kawashita et al. | 294/81.4 |
| 4,068,878 | A | * | 1/1978 | Wilner | 294/81.53 |
| 4,244,615 | A | * | 1/1981 | Brown | 294/81.51 |
| 4,358,145 | A | * | 11/1982 | Svensson | 294/81.53 |

(Continued)

FOREIGN PATENT DOCUMENTS

| | | | | |
|---|---|---|---|---|
| JP | 402138094 | * | 5/1990 | 294/81.56 |

(Continued)

*Primary Examiner*—Dean J. Kramer
*Assistant Examiner*—Paul T. Chin
(74) *Attorney, Agent, or Firm*—Fulwider Patton LLP

(57) ABSTRACT

The multipurpose spreader attachment includes in a first preferred embodiment projections on an underside that define sockets to be engaged with complimentary bosses located on the upper surface of a cargo cage. A latching mechanism is provided to effect a locked arrangement between the spreader and the cargo cage to couple to the cargo cage reliably and securely. The cargo cage is adapted to accommodate both the heavy lifting equipment as well as the pallets of goods to be unloaded, such that the need to change riggings for moving the fork lift and moving the cargo is eliminated. Moreover, the multipurpose spreader is equipped with cables that preferably include actuable hooks that suspend from the spreader and can be opened and closed via an actuator on the spreader. The hooks are adapted to cooperate with connectors such as rings on the preslung pallets, allowing the crane and multipurpose spreader to lift the preslung pallets in addition to the cargo cages. When the preslung pallets are moved to their destination, the actuated hooks are released from the connectors via the actuator and the actuated hooks are stowed within the spreader framework so as to avoid interference with the other loading/unloading operations.

3 Claims, 10 Drawing Sheets

U.S. PATENT DOCUMENTS

| | | | | | |
|---|---|---|---|---|---|
| 4,462,627 | A | | 7/1984 | Kudlicka | |
| 4,550,940 | A | * | 11/1985 | Schweikert | 294/67.4 |
| 4,736,975 | A | * | 4/1988 | Perez et al. | 294/81.55 |
| 5,052,734 | A | * | 10/1991 | Hasegawa et al. | 294/81.53 |
| 5,163,726 | A | * | 11/1992 | Boos et al. | 294/81.5 |
| 5,232,257 | A | * | 8/1993 | Koide et al. | 294/81.56 |
| 5,350,210 | A | | 9/1994 | Barnett et al. | |
| 5,354,112 | A | * | 10/1994 | Hara et al. | 294/81.5 |
| 5,522,633 | A | * | 6/1996 | Massi | 294/81.55 |
| 6,053,550 | A | | 4/2000 | Paterson | |
| 6,138,846 | A | * | 10/2000 | Baumann | 294/81.51 |
| 6,145,903 | A | | 11/2000 | Stinis | |
| 6,312,213 | B1 | | 11/2001 | Stinis | |

FOREIGN PATENT DOCUMENTS

| | | | | |
|---|---|---|---|---|
| JP | 403073792 | * | 3/1991 | 294/81.56 |
| JP | 406144769 | * | 5/1994 | 294/81.56 |

* cited by examiner

FIG. 11
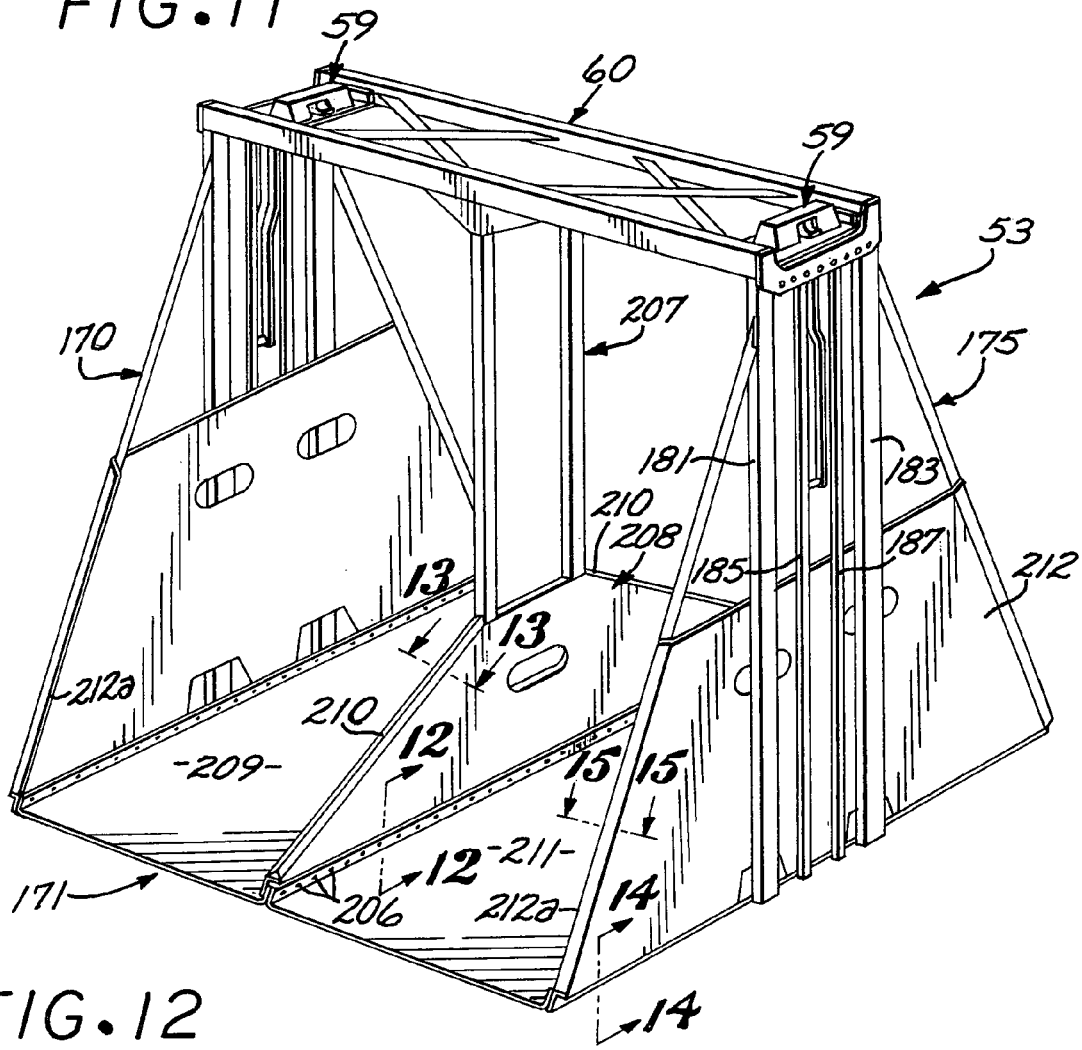
FIG. 12
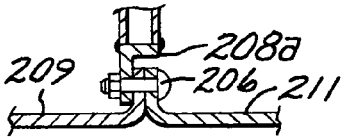
FIG. 13
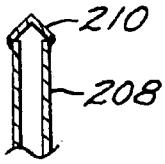
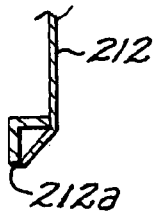
FIG. 15
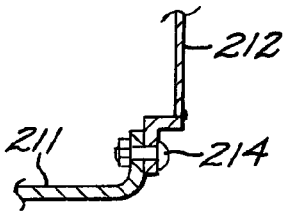
FIG. 14

FIG. 20
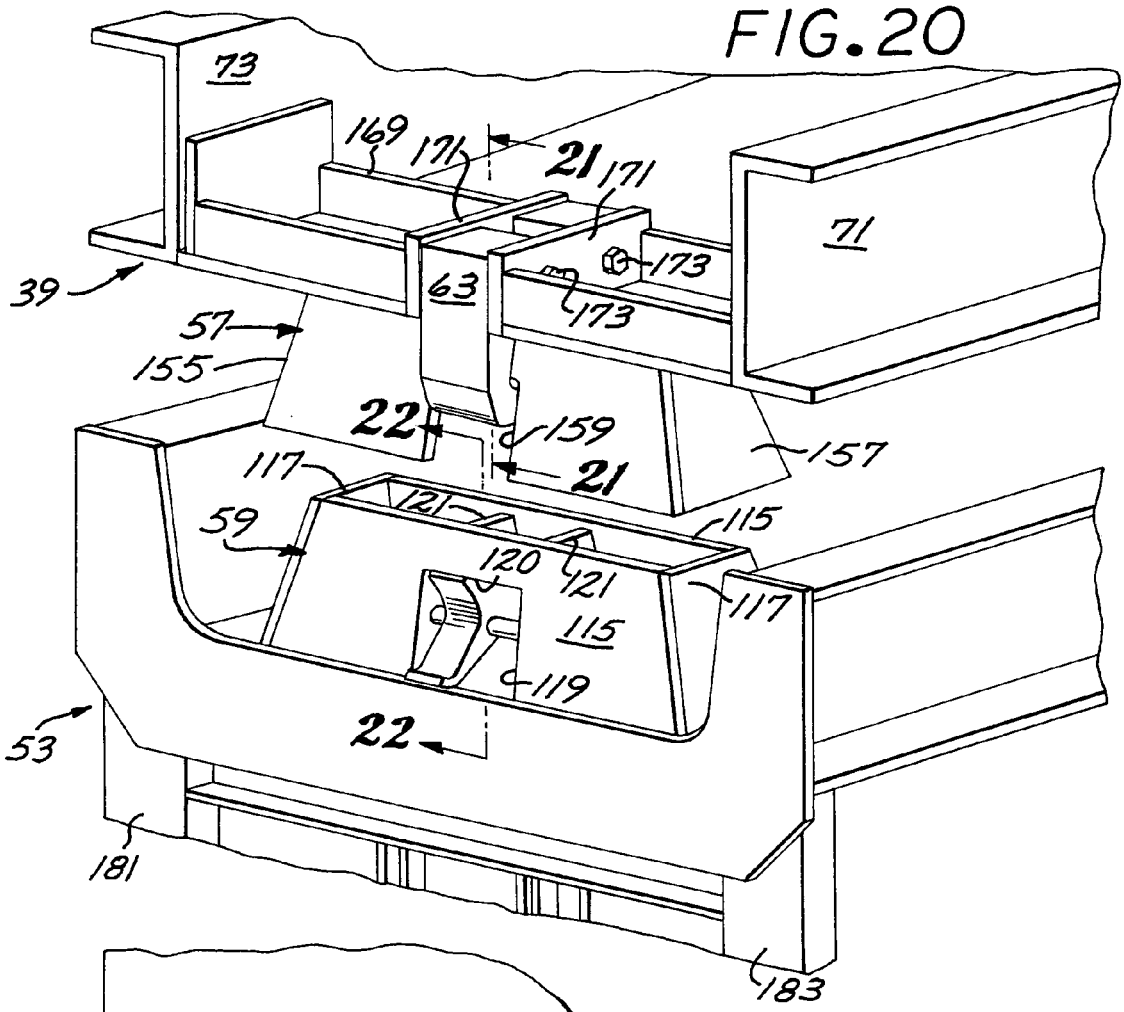
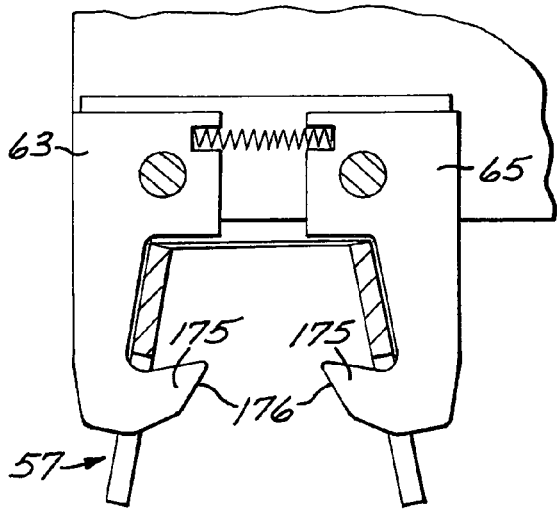
FIG. 21
FIG. 22
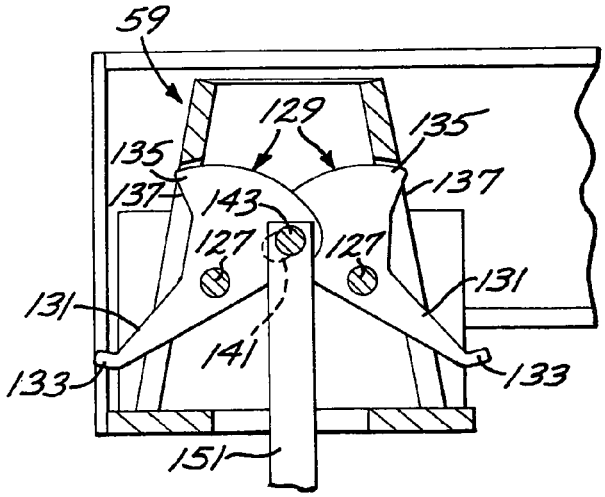

FIG.23
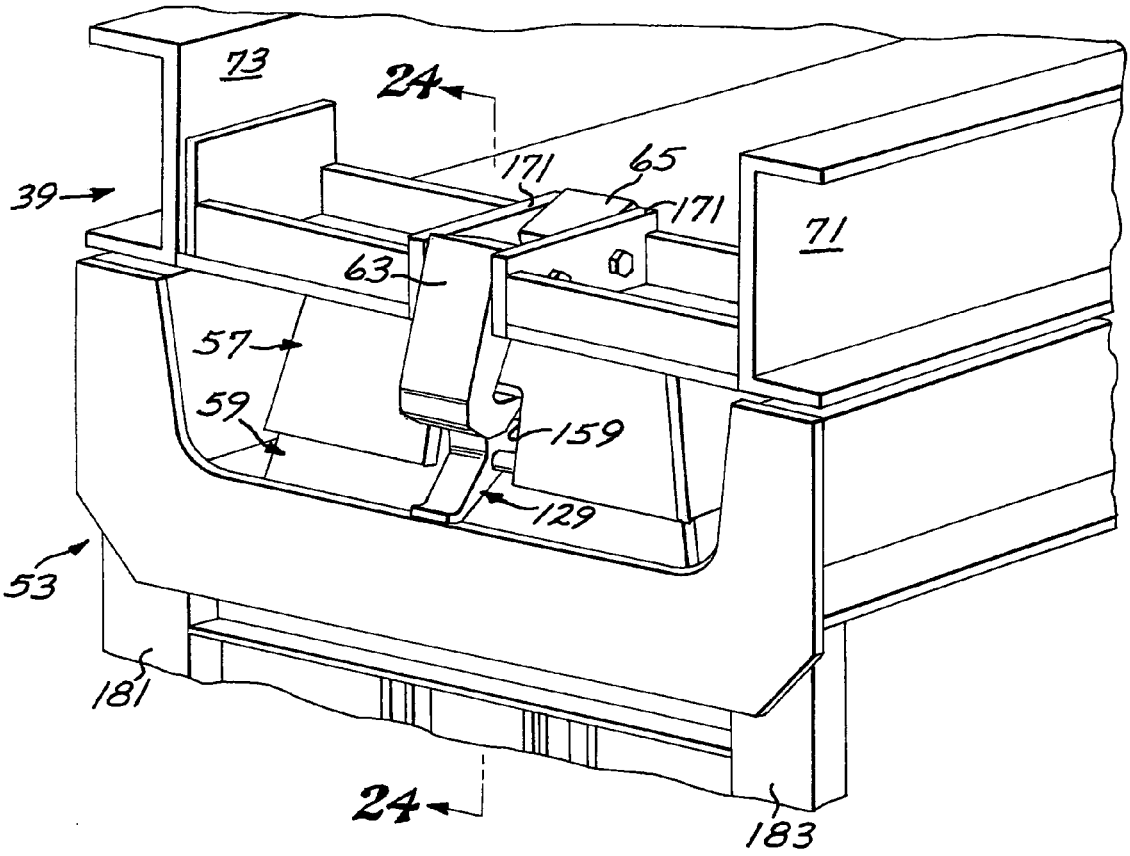
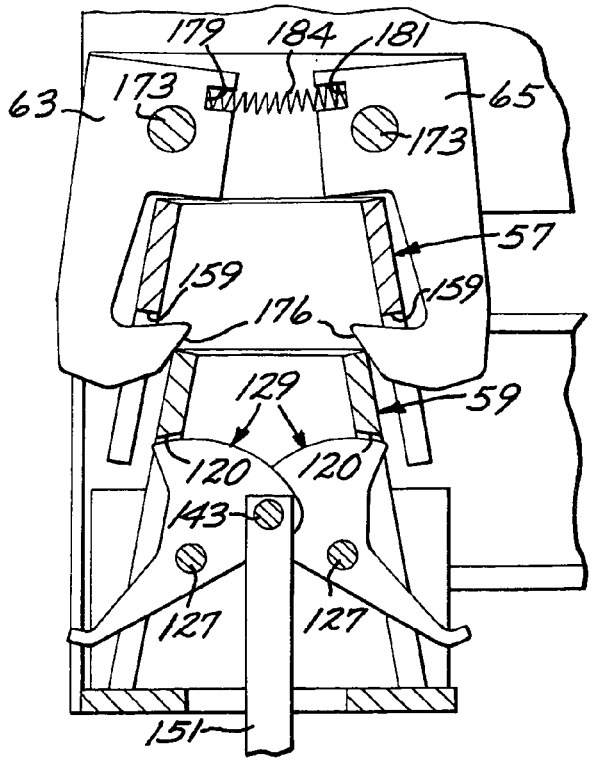
FIG.24

FIG. 25
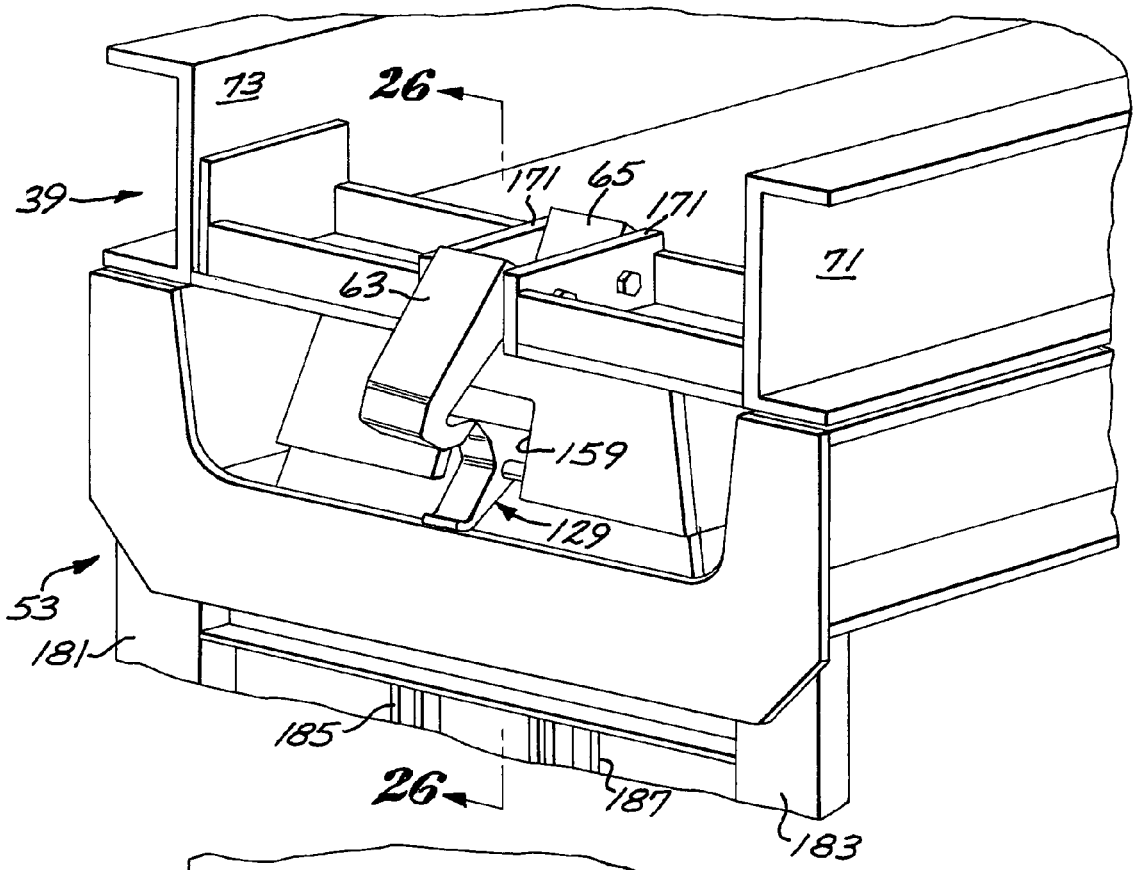
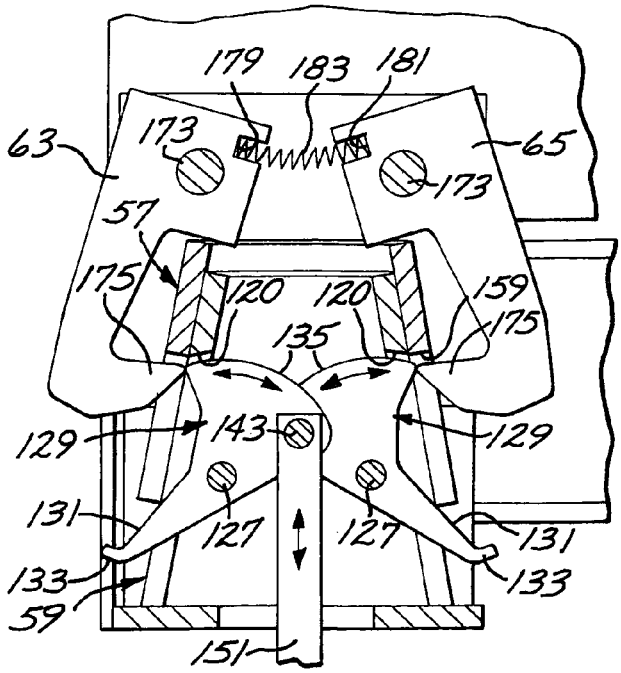
FIG. 26

FIG. 27
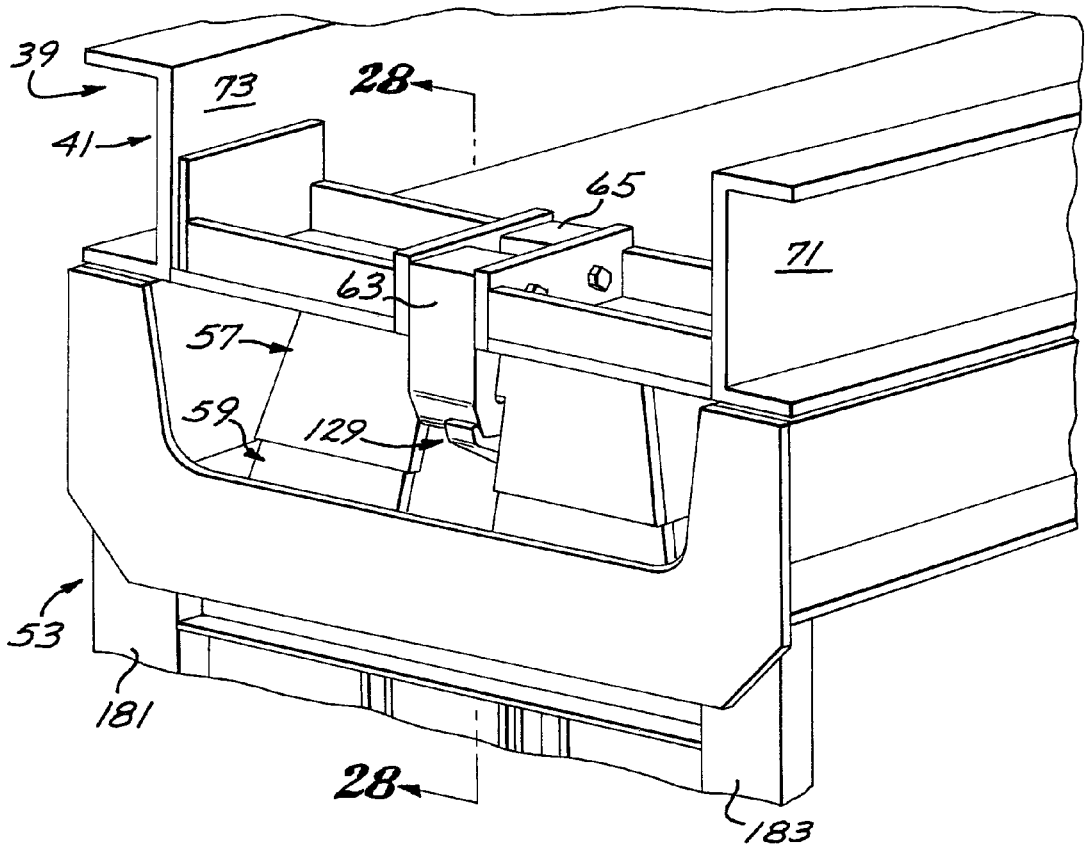
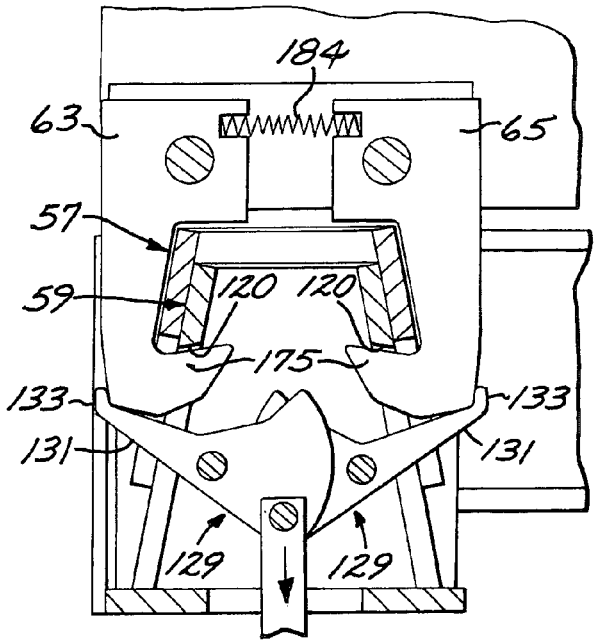
FIG. 28

CARGO CAGE AND SPREADER ATTACHMENT AND METHOD OF USE

BACKGROUND OF THE INVENTION

1. Field of the Invention

The present invention relates generally to cargo lifting apparatus and methods, and more particularly to a multipurpose cargo cage and a spreader attachment for carrying out various cargo transportation operations without the necessity of rerigging the apparatus.

2. Description of the Prior Art

It is common among the shipping industry to load into the hold of a ship various goods produced at a first location and transport the goods to a remote location. An example of such goods frequently shipped via this mode is citrus. Citrus is traditionally transported by first packaging the citrus into crates or boxes, and then loading a quantity of crates onto pallets adapted to be picked up and moved by fork lifts. As can be appreciated, the use of fork lifts and pallets increase the production and economy of moving the goods from one location to another.

Cargo ships used to transport citrus typically include multiple decks for storing the pallets loaded with crates. As the lower decks are filled with pallets, the maneuverability within the ship's hold is gradually reduced until, as the last few pallets are loaded in the top deck, there is no longer any room to permit machinery such as a fork lift to operate. To solve this problem, the final pallets to be placed in the hold are configured with belts or cables (i.e., preslung) that permit the pallets to be dropped into the hold directly with an overhead crane. When unloading the ship, a crane is first used to remove the last-loaded pallets using the belts or cables. To lift the preslung pallets, the crane is fitted with a rigging including a spreader attachment adapted to lift the preslung pallets. The crane raises the initial pallets until they clear the ship's deck, and then the crane swings laterally stopping above a dockside platform where the pallets are lowered for unloading or reloaded for ground transportation.

Once the initial pallets immediately under the hatchway are removed creating a cleared area on the top deck, the crane may lower the first spreader to the dock to be disconnected and a second spreader with different rigging is adapted to lower heavy machinery such as a fork lift picked up to transfer the machinery to the ship's hold. This rerigging of the crane is necessary to place the fork lift in the ship's hold, but comes at a cost of time and manpower. Once the fork lift is located in the hold, the second spreader is removed from the crane and a third spreader is placed on the crane. This third spreader is adapted to lift large cargo cages loaded with crates or cartons of citrus and the like. The cargo cages are lifted and swung to the dockside platform until the entire cargo has been unloaded from the ship's hold. Finally, the third rigging must be replaced again with the second rigging so that the heavy equipment can be removed from the ship's hold. The unloading operation just described requires a minimum of four rigging changes to effect the loading and unloading operations. Each time the crane must be fitted with a new rigging, time is wasted and manpower is spent waiting for the spreader exchange to be effected.

There are many types of spreaders, slings, and lifting devices in the prior art for lifting a pallet or a cargo cage. U.S. Pat. No. 5,163,726 to Boos et al. discloses a spreader bar and overheight attachment with an automatic latching mechanism. Koide et al., U.S. Pat. No. 5,232,257, discloses an automatic hooking apparatus and ship cargo gear using the same. U.S. Pat. No. 5,052,734 to Hasegawa et al. discloses a cargo container lifting spreader compensating mechanism for facilitating engagement by the spreader with cargo containers having out-of-plane twistlock engagement receptacles with rotatable connectors. Perez et al., U.S. Pat. No. 4,736,975 is directed to an apparatus and method for loading and unloading pallets with a sling. Schweikert, U.S. Pat. No. 4,550,940, discloses a pallet-bar lift and support apparatus. U.S. Pat. No. 4,358,145 to Svensson discloses a lifting device for a container with reciprocating coupling mechanisms. U.S. Pat. No. 4,068,878 to Wilner discloses a twist lock coupling for use in handling cargo containers of the type used in I.S.O. systems. While the aforementioned systems and apparatus are directed to various attempts to reliably lift cargo, the art lacks a device and system for achieving the objectives and goals of the present invention.

SUMMARY OF THE INVENTION

The present invention is characterized by a multipurpose spreader attachment that cooperates with a cargo cage to perform each of the aforementioned loading operations without the need to change riggings. The multipurpose spreader attachment includes in a first preferred embodiment projections on an underside that define sockets to be engaged with complimentary bosses located on the upper surface of a cargo cage. A latching mechanism is provided to effect a locked arrangement between the spreader and the cargo cage to couple to the cargo cage reliably and securely. The cargo cage is adapted to accommodate both the heavy lifting equipment as well as the pallets of goods to be unloaded, such that the need to change riggings for moving the fork lift and moving the cargo is eliminated. Moreover, the multipurpose spreader is equipped with cables that preferably include actuable hooks that suspend from the spreader and can be opened and closed via an actuator on the spreader. The hooks are adapted to cooperate with connectors such as rings on the preslung pallets, allowing the crane and multipurpose spreader to lift the preslung pallets in addition to the cargo cages. When the preslung pallets are moved to their destination, the actuated hooks are released from the connectors via the actuator and the actuated hooks are stowed within the spreader framework so as to avoid interference with the other loading/unloading operations.

BRIEF DESCRIPTION OF THE DRAWINGS

The exact nature of this invention, as well as its objects and advantages, will become readily apparent to one of skill in the art upon reference to the following detailed description when considered in conjunction with the accompanying drawings, in which like reference numerals designate like parts throughout the figures thereof, and wherein:

FIG. 11 is an elevated perspective view of a first preferred embodiment, in reduced scale, of a cargo cage for use with th spreader shown in FIG. 1;

FIGS. 12–15 are various cut-away sections sectional views, in enlarged scale, taken along the respective lines 12—12, 13—13, 14—14, and 15—15, of FIG. 11;

FIG. 20 is an expended perspective end view of the spreader and cargo cage shown in FIG. 16;

FIG. 21 is a broken-sectional view taken along line 21—21 of FIG. 20 illustrating the latching mechanism;

FIG. 22 is a vertical-sectional view taken along lines 22—22 of FIG. 20 illustrating the pivoting retainer arms on the boss of the cargo cage;

FIG. 23 is a perspective view similar to FIG. 20 but showing the spreader and cargo cage locked together;

FIG. 24 is a vertical sectional view taken along the lines 24—24 of FIG. 23;

FIG. 25 is a partial perspective view similar to FIG. 23 but showing the latching mechanisms partially engaged;

FIG. 26 is a vertical sectional view taken along the lines 26—26 of FIG. 25;

FIG. 27 is a partial perspective view similar to FIG. 25 but showing the latching mechanism locked together;

FIG. 28 is a vertical sectional view taken along the lines 28—28 of FIG. 27;

DESCRIPTION OF THE PREFERRED EMBODIMENTS

The following description is provided to enable any person of ordinary skill in the art to make and use the invention and sets forth the best modes contemplated by the inventor of carrying out his invention. Various modifications, however, will remain readily apparent to those skilled in the art, since the general principles of the present invention have been defined herein specifically to provide a multipurpose spreader attachment and cargo cage with associated lifting cables, storage arrangements, and latching mechanisms.

Figure 16:
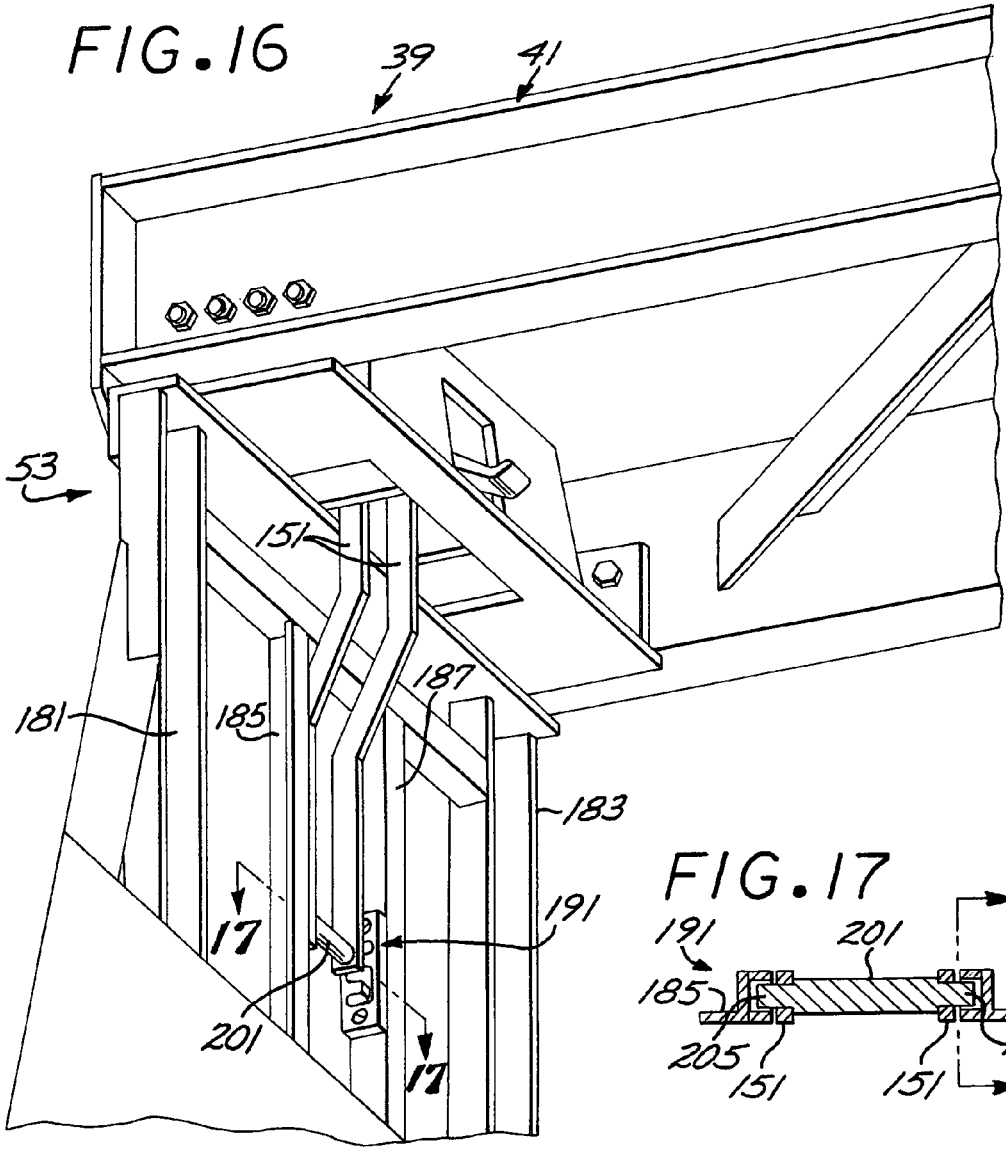
FIG. 16 is a partial lower perspective view in enlarged scale, of the cage shown in FIG. 111 and depicting the handle, linking member, and retaining arm of the cargo cage shown in FIG. 11.

The multipurpose spreader of the present invention includes, generally a horizontal frame 41 (FIG. 1) suspended from boom rigging 43 and having suspended therefrom a plurality of preslung pallet lifting cables 45 carrying hook devices 47 from the respective free ends thereof. The spreader 39 may be selectively utilized to pick up a pre-slug pallet, designated 51 (FIG. 7) or to pick up a cargo cage, generally designated 53 (FIGS. 11 and 16). Mounted under the opposite ends of the spreader are respective frusto pyramidally shaped sockets 57 which open downwardly and are configured for selective engagement over respective upstanding complimentarily shaped bosses 59 mounted on the opposite ends of the cargo cage. Referring to FIGS. 20 and 24, latching hooks 63 and 65 are mounted pivotably to the spreader above the respective sockets 57 and are configured to selectively engage the respective bosses 59 as shown in FIG. 26 to latch the spreader to the cargo cage.

The interior of the frame 41 defines an open storage compartment for the cables 45 and mounted therein are storage brackets 50 to which the hook devices 47 on the free ends of the cables 45 may be selectively hooked to store such cables as the spreader is attached to the cargo cage 53.

Figure 1:
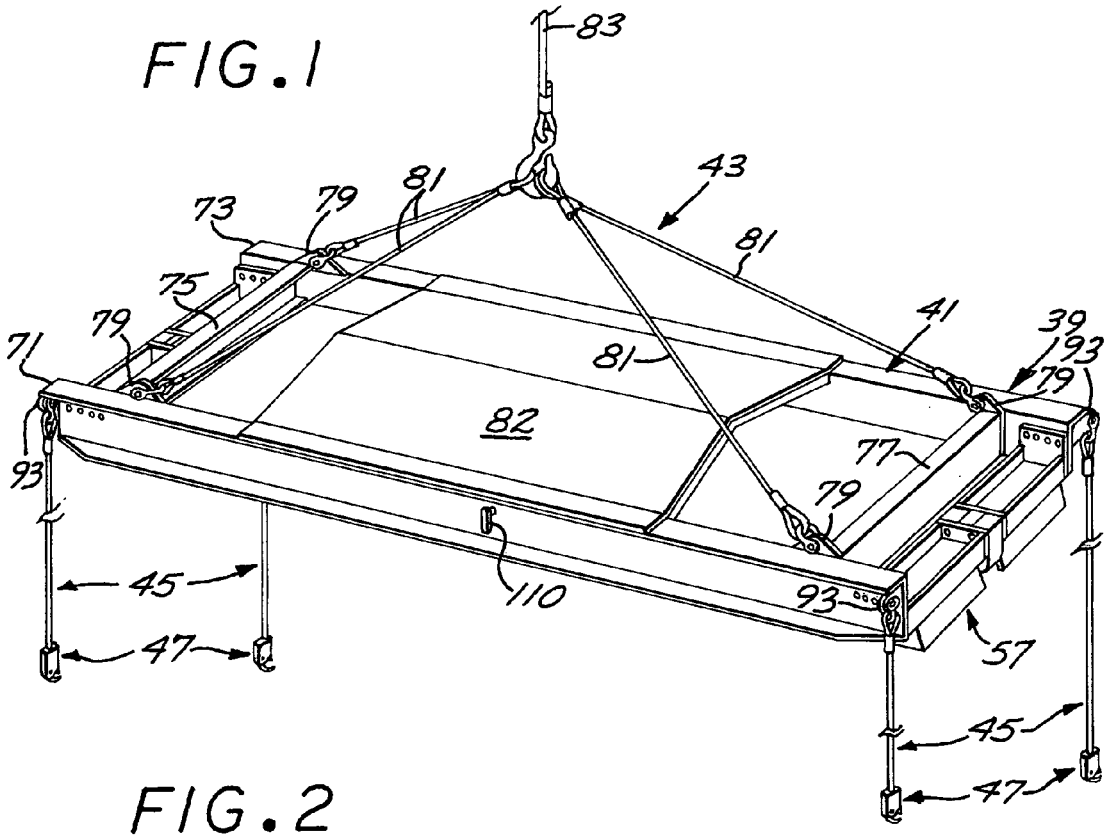
FIG. 1 is a broken elevated perspective view of a first preferred embodiment of the multipurpose spreader of the present invention.
Figure 2:
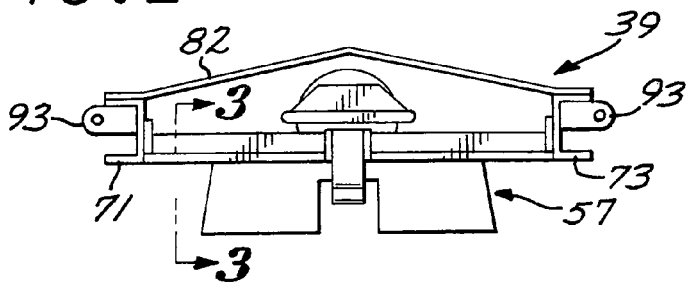
FIG. 2 is a side view of the multipurpose spreader of FIG. 1.
Figure 3:
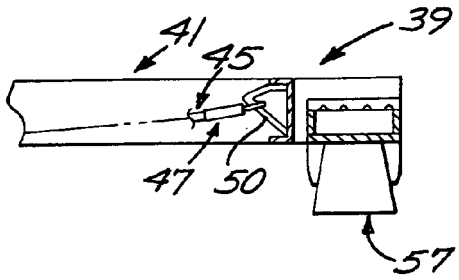
FIG. 3 is a partial vertical cross-sectional view taken along line 3—3 of FIG. 2.
Figure 7:
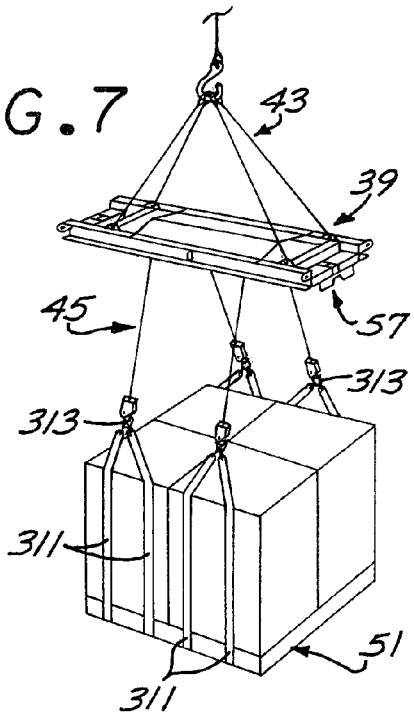
FIGS. 7 and 8 are elevated perspective views in reduced scale of the spreader shown in FIG. 1 depicted lifting a preslung pallets of various sizes.
Figure 31:
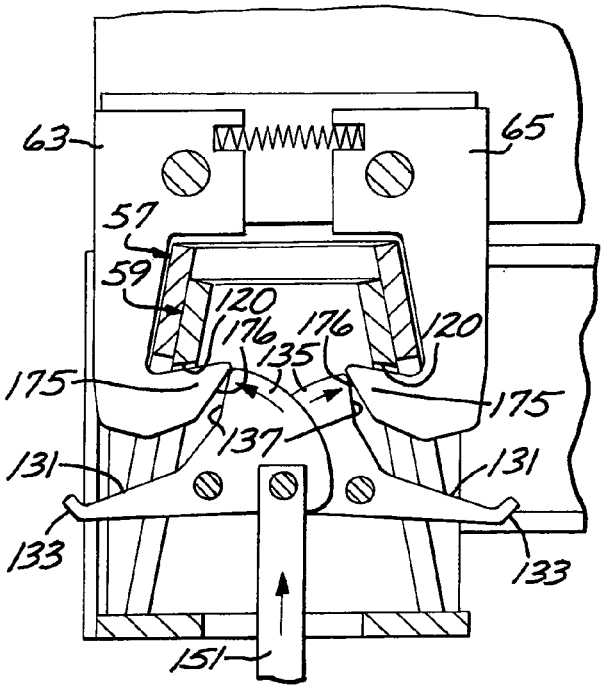
FIG. 31 is a cross-sectional view similar to FIG. 29 and showing the latching mechanisms engaged.

Thus, the cables 45 may be deployed as shown in FIG. 1 for connection with the preslung pallet 51 as shown in FIG. 7 or selectively stored as shown in FIG. 3. When stored as shown in FIG. 3, the spreader may be conveniently lowered onto the cargo cage as shown in FIGS. 20 and 23 to latchingly engage the hooks 63 and 65 shown in FIG. 31 to transport equipment and cargo aboard a containerized cargo vessel as will be described hereinafter.

Referring to the accompanied drawings in detail, the horizontal spreader frame 41 is conveniently constructed with a pair of parallel channel beams 71 and 73 connected together by cross beams 75 and 77 (FIG. 1). Ears 79 are mounted on opposite ends of the cross beams 77 for connection of lifting cables 81 forming the lifting rigging 43 to be suspended from a crane cable 83. A roof 82 is mounted over the central portion of such frame 41.

Figure 6:
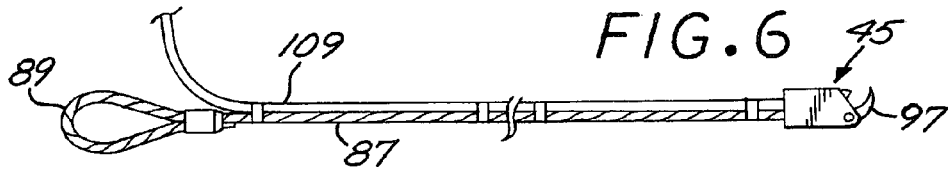
FIG. 6 is a broken longitudinal view in enlarged scale of an actuable hook with a pneumatic line connected as included in the spreader shown in FIG. 1 thereto.

The pallet lifting cables 45 are braided wire cables 87 (FIG. 6) formed at their respective first ends with loops 89 for suspension from suspending eyes 93 mounted at the four corners of the frame 41. The hook devices carried on such cables 45 include pneumatic pistons which selectively rotate respective claws 97 that open and close upon the respective pistons being pressurized or unpressurized.

Figure 4:
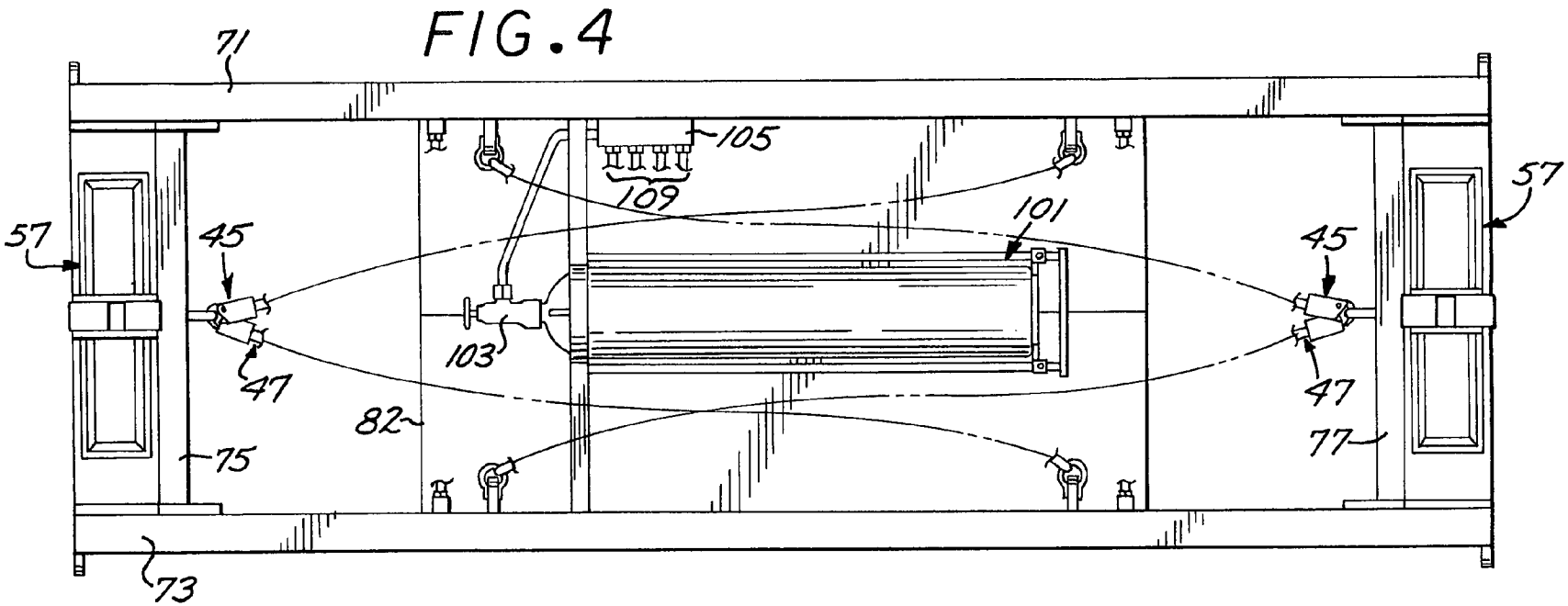
FIG. 4 is a bottom view, in enlarged scale, of the multipurpose spreader of FIG. 1.
Figure 5:
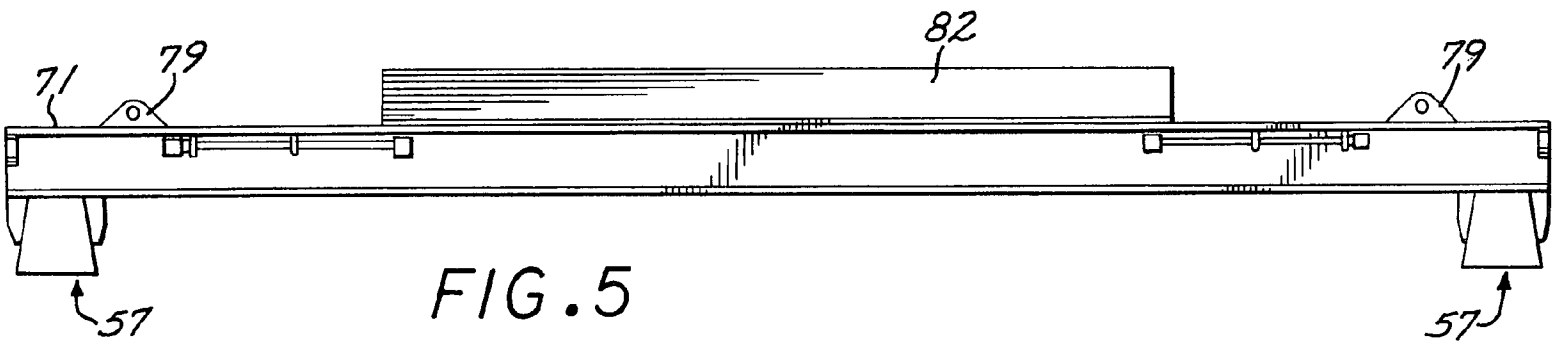
FIG. 5 is a front view of the spreader shown in FIG. 4.

A pneumatic cylinder, designated 101 is mounted centrally in the frame 41 as shown in FIG. 4 and includes a shut-off valve 103 connected with a pneumatic manifold 105 mounted on the interior face of one of the beam 73. Pneumatic lines 109 spread out from the manifold 105 to the respective pistons of the hook devices 45 for selective opening and closing of such hooks. Interposed in the manifold is a control valve biased to its closed position but operable by a pusher rod driven by a pivotal actuator lever 110 mounted on the outside of the beam 71 (FIG. 1) and including a pressure plate to be engaged by, for instance, the distal end of an activation pole (not shown) Referring to FIGS. 20 and 21, the bosses 59 are frusto pyramidal in shape and include downwardly and outwardly diverging side and end walls 115 and 117 to form respective hollow boss receiving compartments. The side walls 115 are formed with outwardly opening windows 119 terminating in respective top edges 120 to be hooked by the respective hooks.

The sockets 57 are frusto pyramidal in shape and are formed with respective downwardly and outwardly diverging side and end walls 155 and 157 (FIG. 20). The walls 155 are formed with downwardly opening hook-receiving slots 159. Between the respective channel beam 71 and 73 are transverse slats 169 and a pair of hook mounting brackets 171 spaced laterally apart. The brackets 171 mount a pair of horizontally projecting bolts 173 which define horizontal pivot pins (FIG. 26) that mount the upper extremities of the respective hooks 63 and 65. The hooks project vertically and are formed with respective inwardly projecting bites 175 configured to be selectively received inwardly within the respective windows 159. The confronting edges of the pairs of hooks are formed with outwardly and downwardly diverging cam surfaces 176 (FIG. 21) to engage the top edges of the respective bosses 59 to slide downwardly and outwardly thereon. The confronting edges of the upper extremities of the hooks 63 and 65 are formed with respective confronting aligned blind bores 179 and 181 which receive the opposite ends of a compression spring 184 configured to urge such upper extremities laterally apart to urge the respective bites 175 of such hooks towards each other into hooking engagement (FIG. 28).

Mounted between such walls are a pair of vertical spaced apart keeper mounting brackets 121 which mount therebetween a pair of horizontal spaced apart keeper pivot rods 127 (FIG. 22) that, in turn, mount respective keeper/kickers, generally designated 129. The keeper/kickers 129 are somewhat triangularly shaped and are formed with respective radially projecting keeper arms 131 terminating in their respective free ends in respective keeper catches 133. Projecting diametrically in the opposite direction from the arms 131 are pie shaped kickers 135 formed with radially projecting kicker surfaces 137 (FIGS. 22 and 26). The kickers 135 are formed with respective juxtaposed through connector slots 141 which receive a link connector pin 143 connected with the upper end of respective vertical control links 151.

Figure 17:
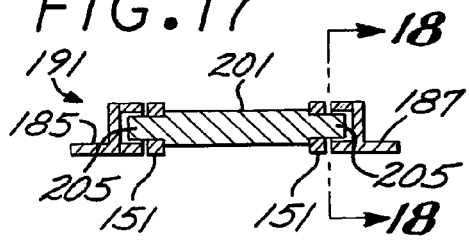
FIG. 17 is a cut-away view, in enlarged scale, of the handle in its raceways taken along the lines of FIG. 16, 17—17.
Figure 18:
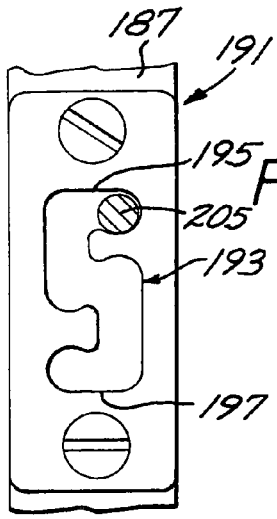
FIGS. 18 and 19 are cross-sectional views taken along line 18—18 of FIG. 17 showing the handle positioned in the locked and unlocked positions, respectively.

Referring to FIG. 11, the cargo cage 53 is configured with a bottom wall defining a floor, generally designated 171 having a pair of upstanding columns 170 and 175 mounted on the opposite sides thereof and projecting upwardly to mount a horizontal frame work 60. The columns 170 and 175 each include a pair of vertical channel beams 181 and 183 having mounted therebetween respective parallel vertical angles 185 and 187. Referring to FIG. 16–18, mounted on the insides of the respective angles 185 and 187 in a confronting relationship are a pair of latch plates generally designated 191. These latch plates include respective S shaped raceways, generally designated 193 having a horizontal top run defining a kicker slot 195 and a horizontal bottom run defining keeper slot 197.

The links 151 (FIG. 16) projects downwardly from the respective bosses and are joined on their bottom extremities by a horizontal handle rung 201 which projects outwardly through the respective links to form axially projecting respective followers 205 received in respective S slots 193.

The cargo cage 53 includes a central partition, generally designated 207 to divide the bottom floor 171 into two side by side stalls 209, 211. The construction of the entrance edges and mating surfaces of the cargo cage are preferably arranged so that there are not blunt surfaces to catch or snag on as cargo is introduced into the cargo cage. For example, a cross section of the leading edge of central partition 207 at a base support panel 208 shows a double walled panel attached by an angled cover 210 (FIG. 13) to divert oncoming cargo into either stall 209 or stall 211. The double-walled structure of the base support panel 208 reduces to a single bracket 208*a*, where it is secured to the upturned mating edges of the bottom floor at side stalls 209, 211 by a plurality of spaced apart fasteners 206 (FIG. 12). The lateral walls 212 of the cage 53 preferably comprise single-walled sheets shaped to a bevel at a leading edge 212*a* as shown in FIG. 15, and mating with the floor using fasteners 214 as shown in FIG. 14.

In operation, it will be appreciate that the spreader 39 may be carried from the trolley of, for instance, a gantry crane by the suspension cable 83 as shown in FIG. 1. The spreader is particularly useful in off loading a ship where the area immediately below a hatch way has been loaded with a preslung pallets similar to the pallets 51. These preslung pallets typically include a plurality of pallet lifting straps 311 slung over the loaded pallets and having eyes 313 on the upper extremities thereof which may be connected with the hook devices 97. To this end, the spreader 39 will be swung over the hatch way and lowered into the hold so that the hook devices 45 may be opened and hooked to the respective eyes 313. The spreader 39 will then be lifted to lift the loaded pallet 51 clear of the hold and moved along the gantry crane to dockside and lowered. With the pallet 51 resting on a trailer on such dock and slack in the lifting cable 83, workmen may approach the spreader 39 and reach up with a actuator pole to engage the actuator 110 (FIG. 1) to actuate the control valve to pressurize the respective pneumatic pistons controlling the respective claws 97 (FIG. 6) to release the hooks and free the spreader. This step may then be repeated until the number of preslung pallets have been removed from the area immediately under the hatchway.

Then, to commence moving the cargo about within the hold, the spreader may be readily prepared by merely lowering it to the height where workman can grasp the cables 45 and shift them to their respective horizontally disposed storage positions within the frame 41 and hook the hooks to the respective storage brackets 50 (FIG. 3) to secure such cables in their respective stored positions.

The spreader is then ready for convenient attachment to the cargo cage 53. This procedure may be undertaken by trailering such cargo cage 53 into position under the trolley of the gantry crane and lowering such spreader 39 into position thereover. As such spreader is lowered, the respective sockets 57 will be aligned over the respective bosses 59 and continued lowering thereof will cause the frusto pyramidal shape of the sockets and bosses to facilitate alignment thereof. As such spreader is lowered, the respective upwardly converging cam surfaces 176 of the spreader hooks 63 and 65 (FIG. 24) will engage the opposite top edges of the respective bosses to, as lowering of such spreader continues, cause the bites 175 of such hooks to be pivoted outwardly about the pivot pins 173 against the resistence of the respective compression springs 184 such that the cam surfaces will ride downwardly on the opposite sides of the respective bosses until the respective bites come into alignment with the respective openings 119 in the opposite sides of the bosses (FIG. 28). As respective such bites clear the top latching edges 120 of such openings the bite ends of the respective hooks will be free to rotate toward one another under influence of spring 183 to shift the respective bites 175 inwardly to the position shown in FIG. 28 thereby aligning the throats of the respective hooks vertically under the respective boss latch edges 120 (FIG. 28).

Figure 19:
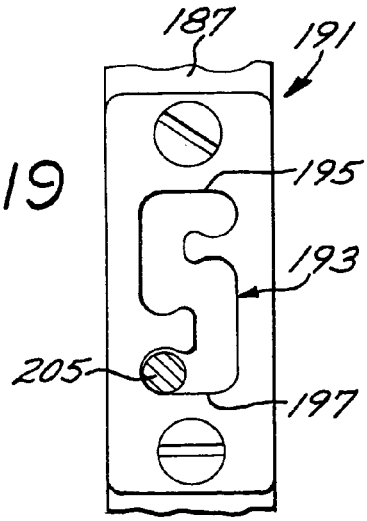
Figure 29:
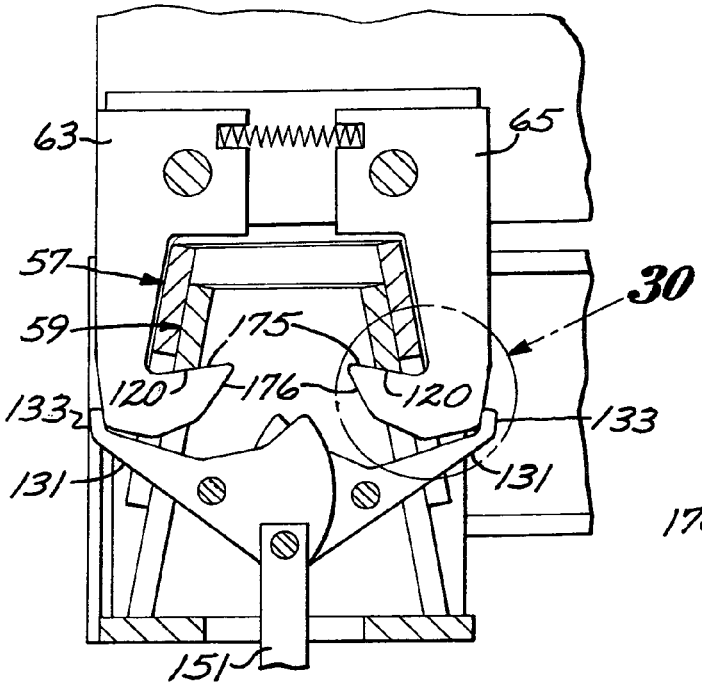
FIG. 29 is a vertical sectional view similar to FIG. 28 but showing the latching mechanism locked together.
Figure 30:
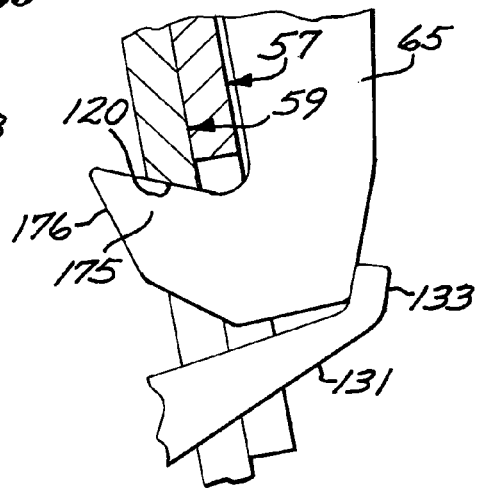
FIG. 30 is an enlarged sectional view taken from the circle shown in FIG. 29.

The spreader 39 will then nest downwardly on the top of the cargo cage and the workmen can grasp the slider latching handle rung 201 (FIG. 16) to draw the handle and the corresponding followers 205 (FIGS. 18 and 19) downwardly in their respective races 193 to the position shown in FIG. 19, thus drawing the respective links 151 downwardly to the position shown in FIG. 28. The lowering of the respective links rotates the keeper/kickers 129 to the respective keeper positions thereby engaging the keeper arms 131 with the opposite sides of the respective lower extremities of the hook 63 and 65 to keep such hooks in their hooking positions.

The cargo cage may then be utilized to transport various equipment and cargo onboard the ship. For instance, fork lift trucks or the like may be driven into the stalls 209 and 211 and the spreader hoisted by the crane cable 83 to shift the cargo cage over the hold and lower it into the space previously cleared away by removal of the preslung pallets. This procedure may then be repeated for the offloading of cargo and transfer of equipment.

When it is desirable to change the load on the spreader 39, the crane may be utilized to shift the cargo gage 53 dock side to a waiting truck or the like. The cargo cage may then be lowered onto the truck and the weight and the crane cable 83 slackened. The workmen may then grasp the respective release handle 201 to shift them upwardly driving the respective followers through the race 193 to the upper position shown FIG. 18 thereby driving the respective control links 151 upwardly through the position shown in FIG. 31. By continuing to drive such links upwardly, the respective kicker surfaces 137 will be driven outwardly against the tips of the respective bites 175 as shown in FIG. 26 to drive the respective bites laterally outwardly clear of the respective latching edges 120 (FIG. 26) to clear the respective bites so that upon lifting of the spreader the hooks will be moved clear of the respective bosses.

Figure 10:
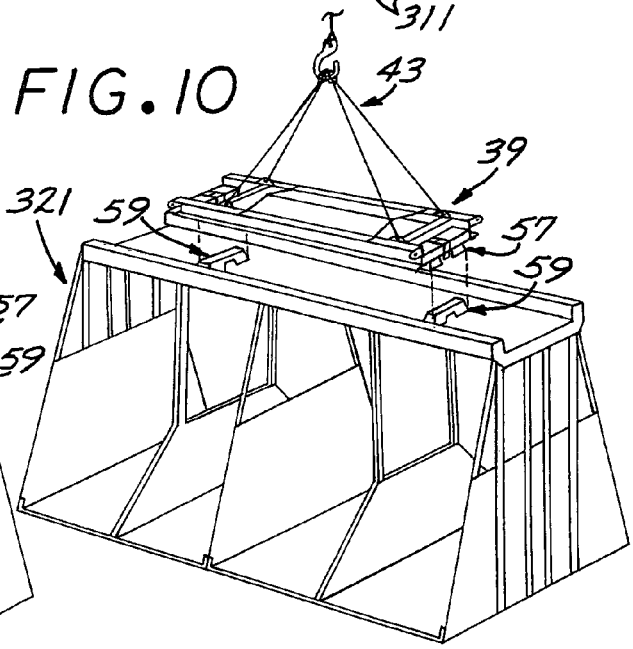

Thereafter, the spreader is free to be moved to another hatch way or to possibly be attached to different cargo cages, jointly designated 321 (FIG. 10) for transfer of different or more equipment or cargo.

Figure 8:
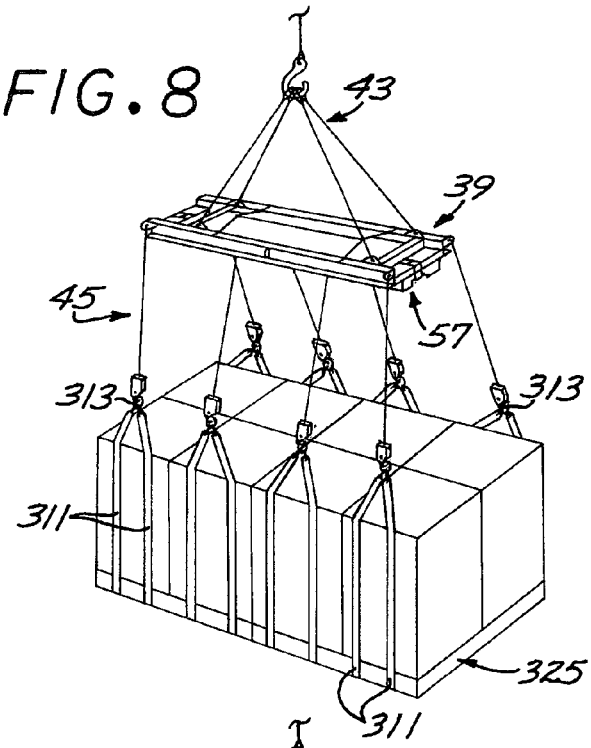
Figure 9:
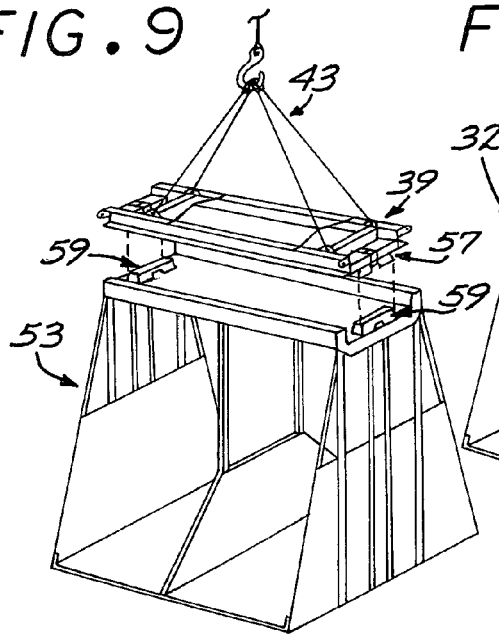
FIGS. 9 and 10 are elevated perspective views in reduced scale of the spreader shown in FIG. 1 depicted picking up cargo cages of various sizes.

In other configurations, the spreader and additional cables 45 carried on the spreader may be deployed to attach to larger cargo pallets, generally designated 325 as shown in FIG. 8.

From the foregoing it will be appreciated that the multipurpose spreader and cargo cage of the present invention provides a convenient reliable, safe and efficient means for offloading and on loading various forms of cargo equipment carrying devices without the necessity of changing from one style of a spreader to another. This serves to avoid inefficient down time and the labor intensive tasks of changing spreaders between the various stevedorian functions.

What is claimed is:

1. Multipurpose spreader and cargo apparatus comprising:

a horizontal spreader including a frame having a pair of downwardly open frusto pyramidal shaped hollow sockets including opposite walls diverging downwardly and outwardly, at least one of the walls of at least one of the sockets being formed with a horizontally outwardly opening window;

a horizontal pivot pin mounted above at least one of the walls;

a latching hook depending from the pivot pin and including a bite, the hook being rotatable between an unlatched position and a latched position with the bite projecting laterally inwardly into the window;

a cargo cage including a horizontally disposed upper frame;

the cage including a pair of upstanding upwardly and inwardly tapering bosses, the bosses including respective upwardly and inwardly converging opposite side walls configured to be complimentarily received in a nesting position in the respective sockets, a respective one boss to be received in the socket and including one wall being formed with an opening for receipt of the bite of the hook and having a top latch edge to be disposed, when at least one of the bosses is in the nesting position in the one of the sockets aligned over the bite of the hook when the hook is in the latched position;

a keeper mounted on the at least one of the bosses adjacent the opening and rotatable from a keeping position to a release position, the keeper including an arm projecting to, when in the keeping position, engage the hook to maintain it in the hook latched position and a control link connected with the keeper to selectively shift the keeper to the keeping position.

2. A method for attaching a multipurpose spreader with a cargo apparatus comprising:

providing a horizontal spreader including a frame having a pair of downwardly open frusto pyramidal shaped hollow sockets including respective opposite walls diverging downwardly and outwardly, at least one of the respective walls formed with a horizontally outwardly opening window having downwardly facing latching edges;

providing a horizontal pivot pin mounted above at least one of the walls;

providing a latching hook depending from the pivot pin and including a bite, the hook being rotatable between an unlatched position and a latched position with the bite projecting laterally inwardly into the window;

providing a cage including a pair of upstanding upwardly and inwardly tapering bosses configured to be complimentarily received in the respective sockets, the bosses including respective downwardly and outwardly diverging opposite walls configured to be complimentarily received in the respective sockets, at least one wall of the respective socket being formed with an opening for receipt of the respective bite of respective hook movably mounted on the respective sockets, the openings having respective top latch edges to be disposed, when the bosses are in latching position within the respective sockets, vertically over the respective bites of the respective hooks when the hooks are in their respective latching positions;

bringing the cage and the spreader in vertical alignment with the bosses on the cage are in registration with the sockets on the spreader, the registration actuating the respective latching hooks to rotate the respective hooks from respective unlatched positions to the respective latching positions;

actuating keepers mounted in the respective bosses adjacent the respective windows to rotate the respective hooks from the respective unlatched positions to respective keeping positions, the keepers including respective arms projecting to, when the respective keepers are in the keeping positions, engage the respective hooks, to maintain them in the respective latching positions.

3. A cargo cage for use with a spreader having at least one downwardly opening socket and at least one pivotable downwardly depending latching hook terminating in a horizontally projecting bite and selectively rotatable between latching and unlatching positions, the cage comprising;

a cage frame including upper frame;

at least one boss mounted on the upper frame and configured to be selectively received in the socket to align the spreader in latching position with the cage;

the at least one boss including a window for selective receipt of the bite and including a downwardly facing latching edge engaged by the bite;

a spring interposed between the cage and hook and biasing the hook to its latching position;

a keeper device mounted in the boss and configured with a keeper arm projecting in one direction and a kicker surface directed in the opposite direction, the keeper arm being rotatable from a keeping position with the keeper arm engaged with the hook to hold the bite in its latching position to a releasing position with the kicker surface engaged with the hook to rotate the hook to a position to clear the bite out of vertical alignment under the latching edge;

a control link connected with the keeper for shifting the keeper between the keeping and releasing positions;

control plate mounted on the cage frame and including an S-shaped control raceway having an upper kicker slot and a lower keeper slot; and the link including a follower received slidably in the raceway and, the link being configured such that when the follower is shifted to the keeper slot, the keeper arm is in its keeping position and when said follower is shifted to the kicker slot, the kicker arm is in the releasing position kicking the bite clear of vertical alignment under the latching edge.

* * * * *